US006045415A

United States Patent [19]

May et al.

[11] Patent Number: 6,045,415

[45] Date of Patent: Apr. 4, 2000

[54] CYLINDRICAL CONTACT TUBE

[75] Inventors: Guntram May, Altdorf; Frank Odorfer, Nuremberg, both of Germany

[73] Assignee: Framatome Connectors International, Courbevoie, France

[21] Appl. No.: 09/122,930

[22] Filed: Jul. 27, 1998

[30] Foreign Application Priority Data

Aug. 8, 1997 [DE] Germany ..... 197 34 524

[51] Int. Cl.[7] ..... H01R 11/22

[52] U.S. Cl. ..... 439/852

[58] Field of Search ..... 439/852, 851, 439/856, 857

[56] References Cited

U.S. PATENT DOCUMENTS 3,363,224 1/1968 Gluntz ..... 439/852
5,207,598 5/1993 Yamada ..... 439/636
5,529,517 6/1996 Hopf ..... 439/851

FOREIGN PATENT DOCUMENTS 0 259 546 A2 3/1988 European Pat. Off. .
1 185 266 1/1962 Germany .

*Primary Examiner*—Khiem Nguyen
*Assistant Examiner*—Javaid Nasri
*Attorney, Agent, or Firm*—Perman & Green, LLP

[57] ABSTRACT

The present invention relates to a cylindrical contact tube (1) having a contact part (2) and a connecting part (3). The contact part (2) has a cylindrical lateral surface (4) with at least one contact spring (5) which is punched out of the lateral surface (4) and orientated essentially parallel to the plug-in direction, the contact spring additionally being coined.

7 Claims, 2 Drawing Sheets

CYLINDRICAL CONTACT TUBE

FIELD OF THE INVENTION

The present invention relates to a cylindrical contact tube according to the preamble of Patent claim 1. Such contact tubes are used, inter alia, in the automobile industry, where, in addition to a certain robustness of the plug-in connection, importance attaches to easy insertion of the mating connector and to a firm contact pressure of the contact elements against one another.

BACKGROUND OF THE INVENTION

Contact tubes are known which are punched out of a metal sheet, the cylindrical tube body being produced by rolling and/or bending the punched metal sheet, and an elastic behaviour being achieved by leaving a gap parallel to the plug-in axis between the facing punched edges, and keeping the inside diameter of the cylindrical tube slightly smaller with respect to the diameter of the plug part to be plugged in, whilst producing holding forces upon plugging in because of the required widening of the cylindrical lateral surface. This type of plug sleeve does not permit an effectively reproducible contact resistance to be produced, since the surface where the plug parts are seated on one another can vary very considerably from one plug to another.

An improvement is achieved in the case of a cylindrical tube by punching out of the cylindrical lateral surface spring tongues which are bent into the tube interior in order thereby to produce defined contact surfaces. This is already a great improvement with regard to the reproducibility of the contact situation. With regard to the elasticity of these contact springs, and to the contact pressure, such contact tubes are still not ideal, however, since although long contact springs permit excellent elastic properties and large spring excursions, they permit only a slight contact pressure. Short contact springs make it difficult to insert the mating connector, but deliver an acceptable contact pressure.

It is the object of the present invention to improve a cylindrical contact tube so as to ensure a large contact pressure between the contact surfaces in conjunction with good elastic properties which simplify the insertion of the mating connector.

This object is achieved in accordance with the claim. The subclaims characterize preferred embodiments of the invention.

BRIEF DESCRIPTION OF THE DRAWINGS

The invention is explained in more detail below with the aid of the description of an exemplary embodiment and with reference to the drawing, in which.

DETAILED DESCRIPTION OF THE INVENTION

Figure 1:
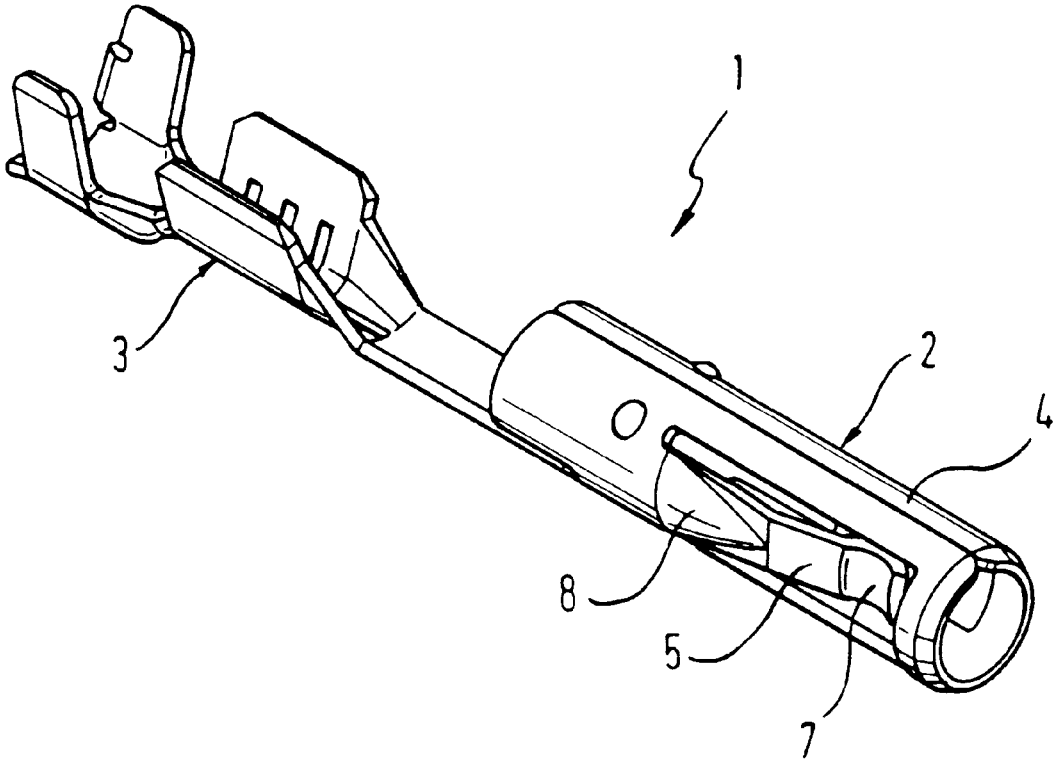
FIG. 1 shows a perspective view of a cylindrical contact tube according to the invention.

The contact tube 1 shown in FIG. 1 has a contact part 2 and a connecting part 3. The contact part 2 has a cylindrical lateral surface 4, which is formed by rolling a punched metal sheet. Visible on the top side of the cylindrical lateral surface is the joining edge where the facing sides of the punched metal sheet abut. To the right and left, contact springs 5 are punched out of the cylindrical lateral surface parallel to the plug-in axis.

The shape and working of this contact spring will be examined in more detail below.

Figure 3:
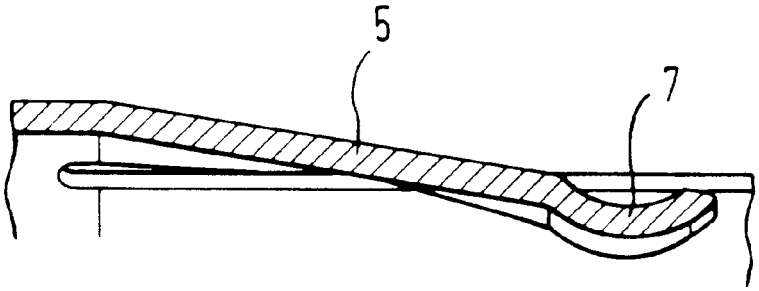
FIG. 3 shows a detailed sectional view of a contact spring.
Figure 2:
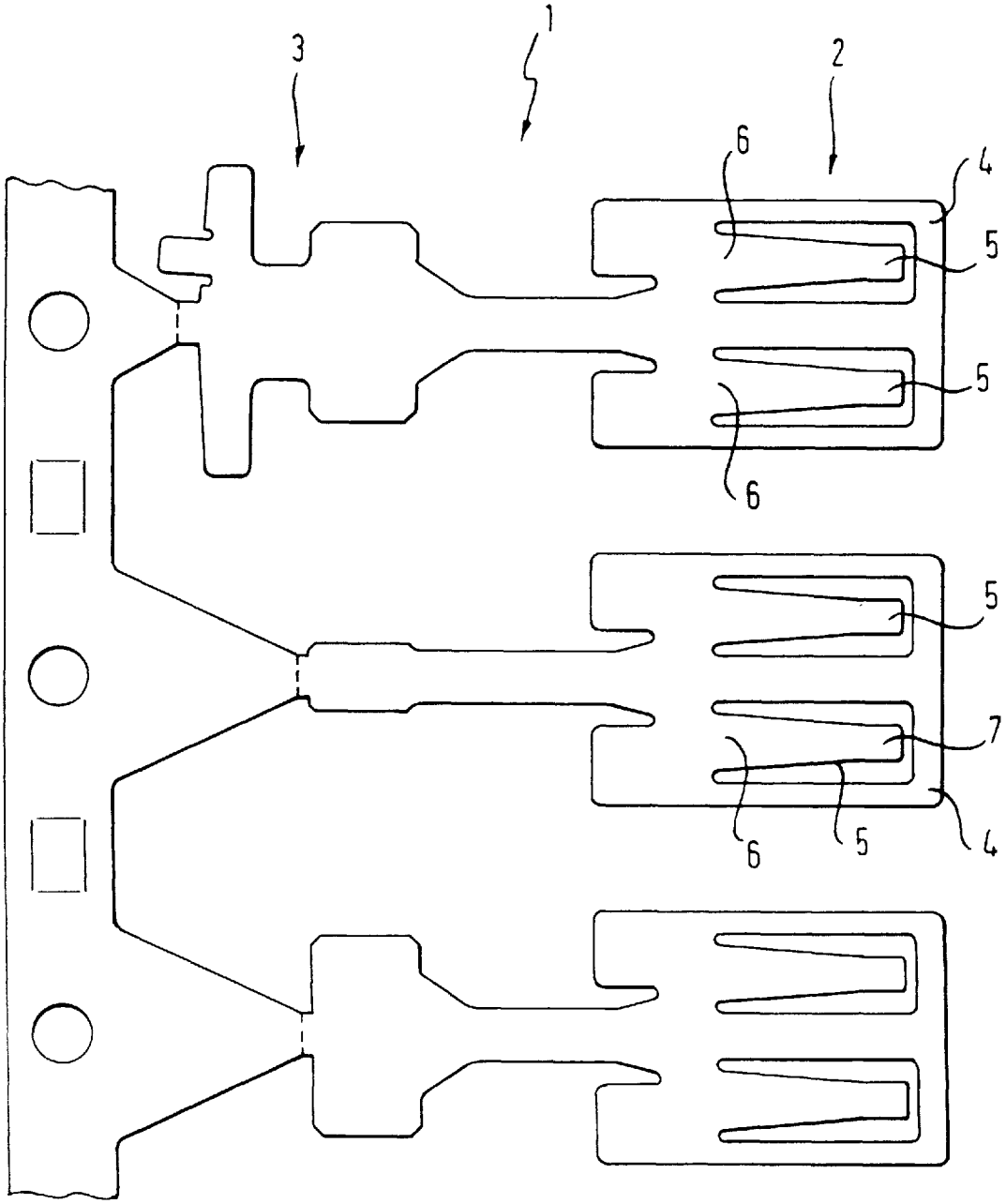
FIG. 2 shows a sectional plan view of a semifinished contact tube.

FIG. 2 shows the punched metal sheet of the contact tube 1 as a semi-finished product in one plane. Visible on the right is the plug part with the cylindrical lateral surface 4, and the punched-out contact springs 5. The free ends of the contact springs extend in the direction opposite to the plugging inlet of the contact tube. Contact springs widen towards their rear end, at which they are connected to the cylindrical lateral surface. The rear region of the contact spring, termed the base region 6 below, is coined with a coining punch in an operation preceding the rolling together of the cylindrical lateral surface so as to produce a bulge in the form of a conical frustum segment, as may be seen from FIG. 1. The coined part 8 increases the stiffness of the contact spring in its base region 6. As is best seen from FIG. 3, adjoining this is an essentially straight spring part which carries the spring tip which is, in turn, coined in the shape of a spoon. The convex surface of the spring contact tip points radially outwards in this case. The result is to ensure a well defined seating point of the contact spring on the mating connector.

As may be seen from FIG. 1, the contact spring tip 7 can also have only a curvature in the shape of a cylindrical segment, the generators of the cylindrical lateral surface extending perpendicular to the plug-in direction of the contact tube.

The contact tube according to the invention combines the advantages of large contact spring lengths, specifically that the contact spring tips can cover a large spring excursion and have an elastic behaviour, with a high contact pressure because the coining achieves a higher contact pressure of the contact spring. The contact tube shown in the figures has two facing contact springs. This is only one possibility of the arrangement of contact springs on a cylindrical contact tube. It is likewise conceivable to arrange only one or three or four contact springs, it also being possible to conceive of a plurality of contact springs at a different height with reference to the plug-in depth of the contact tube.

Furthermore, depending on the application, other coinings of the spring contact are conceivable in order to influence the bending behaviour of the contact spring and also to influence the contact surface on the spring tip exactly as desired.

We claim:

1. A cylindrical contact tube tube (1) having a contact part (2) and a connecting part (3), characterized in that the contact part (2) has a cylindrical lateral surface (4) with at least one contact spring (3) which is punched out of the lateral surface (4) and orientated essentially parallel to the plug-in direction, the at least one contact spring having a base end connected to a tube base having a first radius and another opposite free end, said at least one contact spring having a first coined portion defining a rounded contact point located proximate the free end thereof, and said at least one contact spring further having a second coined portion at the base end thereof, said second coined portion starting at the tube base first radius.

2. The cylindrical contact tube according to claim 1, characterized in that the width of the contact spring (5) decreases from the base (6) of the spring to the free end (7) thereof.

3. Contact tube according to claim 1, characterized in that two facing contact springs are provided which have free ends (7) orientated towards the tube inlet.

4. Contact tube according to claim 1, characterized in that the base region (6) of the at least one contact spring (5) has said second coined portion (8) in the form of a conical frustum segment which stiffens the spring (5) in this region.

5. Contact tube according to claim 1, characterized in that the free end (7) of the contact spring (5) is coined in the shape of a spoon with the convex side radially outwards.

6. Method for producing a contact tube according to claim 1, characterized in that the contact springs are coined with a coining punch between punching out the sheet metal and rolling the semifinished products to form the contact tube.

7. Cylindrical contact tube (1) having a contact part (2) and a connecting part (3), characterized in that the contact part (2) has a cylindrical lateral surface (4) with at least one contact spring (5) which is punched out of the lateral surface (4) oriented essentially parallel to the plug-in direction, the contact spring having a base end connected to a tube base having a first radius and another opposite free end, said contact spring having a first coined portion defining a rounded contact point located proximate the free end thereof, and said contact spring further having a second coined portion at the base end thereof, said second coined portion starting at the tube base first radius whereby said second coined portion defines an outwardly protruding conical frustum segment.

* * * * *

UNITED STATES PATENT AND TRADEMARK OFFICE

CERTIFICATE OF CORRECTION

PATENT NO. : 6,045,415
DATED : April 4, 2000
INVENTOR(S) : Guntram May; Frank Odorfer It is certified that error appears in the above-identified patent and that said Letters Patent is hereby corrected as shown below:

Column 2, claim 1,
Line 47, "(3)" should read -- (5) --.
Line 48, "the" should be deleted.

Column 2, claim 3,
Line 61, "Contact tube" should read -- The contact tube --.

Column 2, claim 4,
Line 64, "Contact tube" should read -- The contact tube --.

Column 3, claim 5,
Line 1, "Contact tube" should read -- The contact tube --.
Line 3, "outwards" should read -- inwards --.

Column 3, claim 7,
Line 8, "Cylindrical contact tube" should read -- A cylindrical contact tube --.
Line 12, "the" should be deleted.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*